United States Patent [19]

Sommariva

[11] 4,441,611

[45] Apr. 10, 1984

[54] MULTIPACK AND METHOD OF MAKING IT

[75] Inventor: Gabriella Sommariva, Milan, Italy

[73] Assignee: MPS - Multi Packaging Services S.r.l., Milan, Italy

[21] Appl. No.: 356,851

[22] Filed: Mar. 10, 1982

[30] Foreign Application Priority Data

Mar. 12, 1981 [IT] Italy ..... 20311 A/81

[51] Int. Cl.[3] ..... B65D 73/00; B65D 5/46; B65D 25/28

[52] U.S. Cl. ..... 206/431; 206/460; 206/813; 229/52 B

[58] Field of Search ..... 206/431, 460, 813; 229/52 B; 294/87.2

[56] References Cited

U.S. PATENT DOCUMENTS

| | | | |
|---|---|---|---|
| 2,677,460 | 5/1954 | Johnson et al. | 206/503 |
| 2,822,208 | 2/1958 | Then | 206/431 |
| 3,113,673 | 12/1963 | Stein | 206/813 |
| 3,221,876 | 12/1965 | Currie | 206/431 |
| 3,245,711 | 4/1966 | Dantoin | 294/87.2 |
| 3,924,739 | 12/1975 | Graresteijn | 294/87.2 |

FOREIGN PATENT DOCUMENTS

| | | | |
|---|---|---|---|
| 2444624 | 8/1980 | France | 206/431 |

*Primary Examiner*—William T. Dixson, Jr.
*Assistant Examiner*—Brenda J. Ehrhardt
*Attorney, Agent, or Firm*—McAulay, Fields, Fisher, Goldstein & Nissen

[57] ABSTRACT

Two or more containers for various products, having a generally parallelepiped shaped, are joined to form a multipack by blanks made of cardboard and the like. The package has a V folded band which is placed and glued between two adjacent containers, and handles to carry it arranged on the extensions of the V folded band. The invention also relates to a method of joining the containers so as to form the multipack.

9 Claims, 8 Drawing Figures

Fig. 3
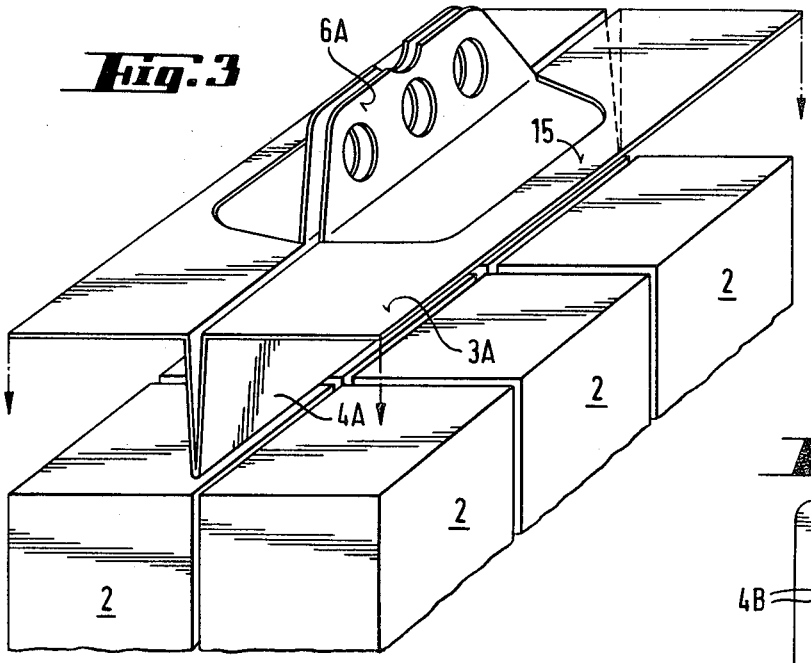
Fig. 4
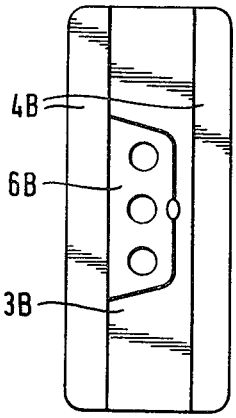
Fig. 5
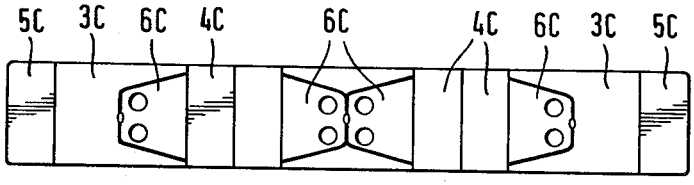
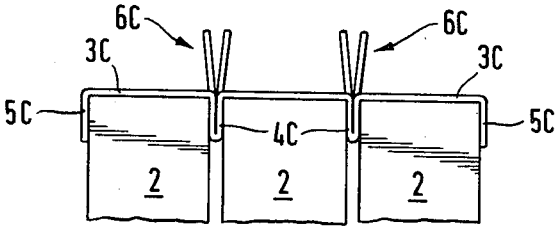
Fig. 5A
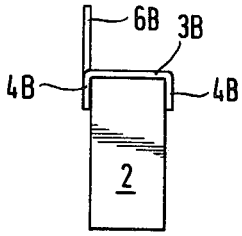
Fig. 4A

MULTIPACK AND METHOD OF MAKING IT

FIELD OF THE INVENTION

The present invention relates to a multipack adapted to join two or more containers, particulary in parallelpiped shape, so as to obtain a single carrying structure. Such a multipack is particularly useful for transportation, easy to make and of low cost, and moreover allows an easy and ready detachment of each container.

BACKGROUND OF THE INVENTION

Several packages are known, adapted to form multipacks for containers having generally a parallelpiped shape, such as for milk, juices, liquids of various nature, rice, sugar, pasta and the like. These packages are mainly of two kinds, the one made by wrapping webs, films or sheets of plastics material, joining together the various containers, and the other consisting of boxes, adapted to hold the required number of containers, possibly simplified and/or modified.

The main drawbacks of wrapping with plastic material are due to the anonymity of the package, lacking any identification and without possibility of applying advertising messages on it, and to some disadvantages of the package itself, such as lack of carrying elements, scarce protection of the containers which are prone to bulging, difficulty of opening the package which is then destroyed even for withdrawing one single container, and so on.

The other packages, generally consisting of a more or less open box of cardboard or the like, have the drawback that being substantially boxes, their size inevitably depend upon the dimensions of the containers. Furthermore their surfaces being rather big, require a higher use of material so they are more expensive. Also these packages often have the disadvantage not to allow withdrawal of only one container without irremediably damaging the package.

SUMMARY OF THE INVENTION

It is an object of the present invention to provide a package adapted to join containers of generally parallelepiped shape, of a particularly simple structure although it allows a firm bond with the containers, of low cost and easy to be carried, and allowing to personalize the packed product with wordings and devices on it.

It is another object of the invention to provide a package of the above mentioned kind, wherein the material used is of less noble, thus less expensive quality, in view of the particularly strong structure of the handle, which makes useless a greater resistance of the remaining parts of the package, which allows also an easy detachment of one or more containers without endangering the package itself.

The multipack according to the present invention is characterized by the fact of having at least a portion or band folded in the form of a V, the inner surface of it being glued to one another, and the outer surfaces of it being at least spot glued to adjacent containers, as well as at least an extension of the V-shape portion acting as a handle to carry the pack.

The method of making said multipack consists of the steps of: (a) forming two rows of juxtaposed containers, placed inside guides; (b) folding in the form of a V a band of the flat fed blanks, (c) applying an adhesive on the inner surfaces of the folded V band and pressing the V band to obtain its closure; (d) applying an adhesive at least on spots on the blank surfaces which are at right angles and adjacent to those being in contact with the longitudinal V band; (e) introducing the so formed central longitudinal V portion of the blank between the two rows of containers; (f) clamp the parts until the adhesive has set and joined the containers to the multipack; and subsequently (g) lift the die cut blank portions provided for forming the handle.

The present invention will be now described with respect to some preferred embodiments given as a non limiting example only, making reference to the accompanying drawings, in which:

FIG. 3 is a perspective view of a simplified embodiment of the multipack according to the present invention; and FIGS. 4 and 5 are plan views and 4and 5*a* are elevational views of two further embodiments of the invention.

DETAILED DESCRIPTION OF THE PREFERRED EMBODIMENTS

Figure 1:
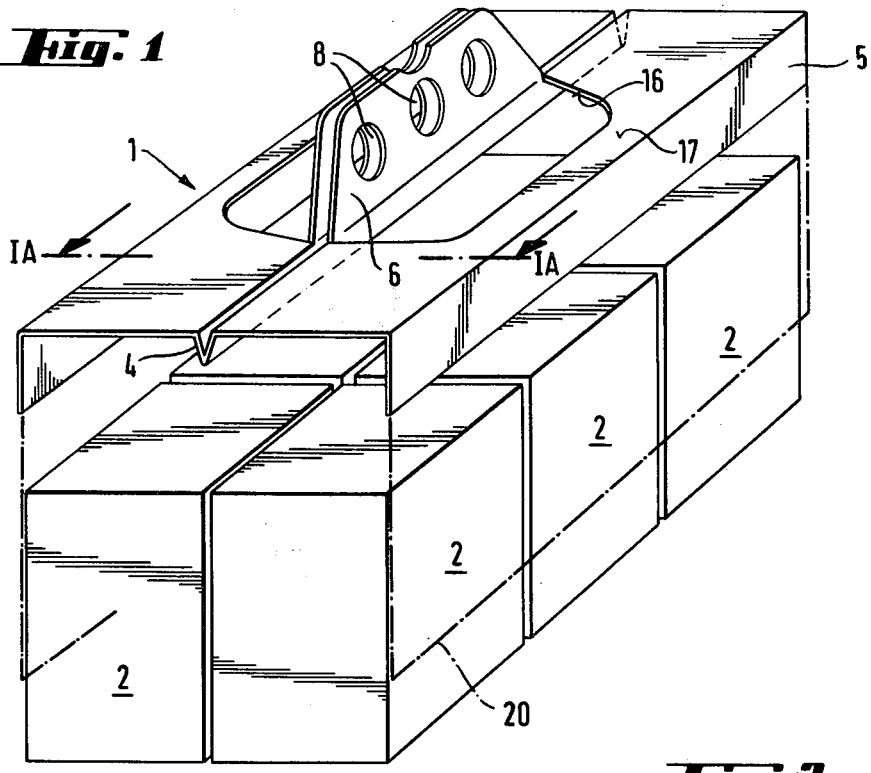
FIG. 1 is a perspective view of a multipack according to the present invention, when being applied to containers.
Figure 2:
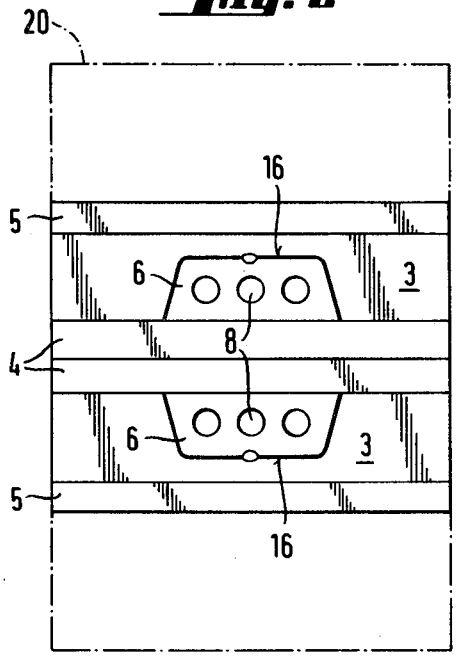
FIG. 2 is a plan view of the flat multipack blank.

With reference now to FIGS. 1 and 2, the multipack 1 of the present invention is adapted to join together a number of containers 2, such as parallelepiped containers of carboard for liquid products, so as to form a block, strong and balanced structure easy to be carried. As one can see in FIG. 1, the containers 2 are arranged on two juxtaposed rows between which a V-folded portion or band 4 is extending so as to cause bond of the parts by adhesion. FIG. 2 shows the plan configuration of the blank of cardboard or any other similar material, from which the package 1 is then made. As previously stated, it has a central portion 4 adapted to be folded in the form of a V or sealing band, two side portions 3 forming the pack upper surface, in which two handles 6 are die cut and provided with holes 8 to make multipack easier to be carried, and lateral flaps 5 to improve the holding engagement, said flaps being of a length varying from zero to the entire height of the package and may also have a fancy contour, the whole independently from one another, as shown for instance by extension 20.

Figure 1A:
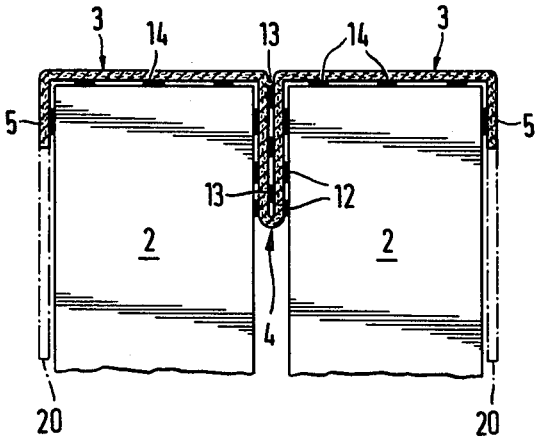
FIG. 1A is a cross-sectional view showing the application of the V-shaped band.

FIG. 1A is a cross-sectional view of the engagement strip, obtained by V-folding the portion 4 and applying a zone or spot thermal welding 12 and 13. These zones or spots may for instance be obtained by molten material, commonly called hot melt, of current use in the field of package sealing, such as liquid containing containers.

The kind of package may of course be any one of those currently used in the technique, provided its resistances may be compared with that obtained with the hot melt spot bond. The two inner surfaces of the V portion are glued to one another by welding zones or bands 13, while the outer surfaces are glued to the containers 2 by continuous or discontinuous welding zones 12. According to the type and weight of the containers, welding spots 14 may be applied under the upper surfaces 3 of the packages or on flaps 5 or both, particularly for containers of a considerable weight.

Die cuts 16 do not extend up to the blank end, but they have a strip or bridge 17, because they should not be coincident with the folding line between upper surfaces 3 and flaps 5 otherwise their detachment cut line 16 may open so as to attain lift up of handle 8 before the purchaser may use the package.

Precut weakening lines 22 may also be provided on the blank so as to make easier detachment of one or more containers. It is clear that such a detachment does not damage the remaining part of the package.

From the foregoing disclosure it is also clear that the holding function between parts is substantially carried out by the V-folded portion 4 and handles 6 once lifted, are acting along a vertical direction, generally lying in the plane of the two sides of the V device, so as not to undergo torsion stresses, as it presently happens in other types of packages.

The embodiment shown in FIGS. 1 and 2 may be made for six containers, as illustrated in said Figure, or for four containers or even for two containers. It is also theoretically possible to increase the number of containers in the longitudinal direction or even in transversal direction by adding two further V-shaped elements, even if the preferred form deemed to be the most useful, is that indicated above.

With reference now to FIG. 3 a simplified structure of the package is shown, which substantially consists of the band 4A, possibly made deeper, and handles 6A with side portions 3 and outer band 15. As it was already pointed out, the holding strength being substantially effected by this component, the package may be carried out in this extremely simplified form, in the event of a relatively low weight of the containers.

The package illustrated in FIG. 4 is similar to that of FIG. 2, with the difference of practically being longitudinally halved. In other words the V-band is reduced to an edge 4B, being present on both sides of the package, and handle 6B is arranged in a noncentral position as shown in the side elevational view. Therefore the package is adapted to join two or more containers in a single row. This embodiment might also be used by swinging the two outer containers so as to create the second row next to the first one, or two of such containers in one single row might be coupled so as to form a double row.

Referring now to FIG. 5, another embodiment is shown, providing for an elongated arrangement with juxtaposed containers and two V-folded bands 4c. Handles 6c are applied on the sides of the V bands and in the central area between the two V bands, respectively, and in this case a spaced double handle is being formed.

Other embodiments, not shown for sake of simplicity, are also possible, always providing however the use of a V-folded and glued band as element holding adjacent containers, as well as handles preferably aligned with the V band. These substantially equivalent packages are intended to fall within the protective scope of the invention.

The manufacturing process may be mechanized on automatic apparatus set according to the circumstances and requirements of production and use.

With reference to the package of FIGS. 1 and 2 the packaging method for obtaining the block structure is now described. The containers are caused to advance on two adjacent rows, suitably spaced and guided. The blanks 1, fed in a flat condition by a suitable magazine, are V folded at the band 4 with suitable equipment such as blades and wheels, receive the hot melt on the inner-face of the V band, which is pressed to obtain adhesion of the two sides, and glue spots are applied first on the outer face of the V band and then on the upper surfaces 3 and/or on the flaps 5. The blank is then superposed on the containers and the package is clamped for the time required to obtain adhesive set and to join the containers to the package.

The so finished package is then checked to be sure that all containers did adhere. This check might for instance be effected by a trap station, wherein the package is held by supports leaving one part of the containers at a time without bottom hold, so that if a container did not adhere, it would fall down and the corresponding defective package would be automatically discarded.

It is to be pointed out that the illustrated and described embodiments were given only as a nor limiting example of the invention, and several modifications, additions, variations and substitutions af elements may be resorted to, without departing however from its spirit and objects, non from its scope of protection, as it is better defined in the appended claims.

I claim:

1. A method of joining articles in boxes or containers of a generally parallelepiped shape to form a multipack package comprising the steps of: die cutting a blank to provide cut lines in the blank defining two spaced areas each comprising three sides of a trapezoid; forming two rows of juxtaposed containers, placed inside guides; folding in the form of a V a band of a blank end positioning said V so that said trapezoidal areas extend outwardly in opposite directions from the end of said band; applying an adhesive on the inner surface of the folded V band and pressing the V band to obtain its closure; applying an adhesive at least on spots on the blank surfaces which are at right angles and adjacent to those being in contact with the longitudinal V band; introducing the so formed central longitudinal V portion of the blank between the two rows of containers; clamping the parts until the adhesive has set and joined the containers to the multipack; and separating said areas along said cut lines from the remainder of said blank and lifting the same to provide handles.

2. A multipack carrier for articles in boxes or containers of a generally parallelepiped shaped comprising a blank having pairs of longitudinal and lateral edges; a depending V-shaped portion intermediate said pair of longitudinal edges adapted to be received between facing containers; said blank having top portions extending outwardly in opposite directions from the ends of said V portion and adapted to overlie the tops of the containers; cut lines in each of said top portions extending outwardly from the end of said V portion and terminating short of the end of said top portion to define a handle in said top portion movable from a first position in which said handle lies in the plane of said top portion to a second position in which said handle extends upwardly in the same plane as a side of said V portion, and a plurality of spaced adhesive spots between the sides of said V portion and the surface of said blank facing the containers.

3. A carrier as in claim 2, in which said V-shaped portion is defined by a centrally located fold line defining the apex of said V portion, and a fold line spaced on opposite sides of said central line.

4. A carrier as in claim 2, in which said blank includes a bridge portion between the handle cut lines and the end of said top portion.

5. A carrier as in claim 2, in which said adhesive spots are located adjacent said cut lines.

6. A carrier as in claim 2, in which said blank includes depending members at the ends of said top portions, and spaced spots of adhesive between said depending portions and the containers.

7. A carrier as in claim 2, in which said adhesive is a hot melt material.

8. A carrier as in claim 2, in which said cut lines are die cut lines, said die cut lines extending in a trapezoital pattern to define a trapezoidal handle, and a plurality of finger holes in said handle.

9. A multipack carrier for containers, comprising a blank having at least one depending portion adapted to abut the side of a container; a top portion joined to said depending portion and extending over the top of the container; die cut lines extending from the junction of said depending and top portions across said top portion and terminating short of the end of said top portion to define a handle therein movable from a first position lying in the plane of said top portion when said blank is connected to the containers, to a second position extending upwardly in the plane of said depending portion, and a plurality of adhesive spots adapted to connect said blank to the container.

* * * * *